United States Patent [19]

Raasch

[11] 4,009,919

[45] Mar. 1, 1977

[54] TRAVELING HOLDER FOR TEXTILE COILS

[75] Inventor: Hans Raasch, Rheydt, Germany

[73] Assignee: Schlafhorst & Co., Monchen-Gladbach, Germany

[22] Filed: Aug. 20, 1975

[21] Appl. No.: 606,336

Related U.S. Application Data

[63] Continuation of Ser. No. 441,337, Feb. 11, 1974, abandoned.

[30] Foreign Application Priority Data

Feb. 10, 1973 Germany ..... 2306688

[52] U.S. Cl. ..... 312/268; 312/223

[51] Int. Cl.[2] ..... A47B 49/00

[58] Field of Search ..... 312/134, 223, 267, 268; 211/1.5, 121, 122; 198/138, 154, 158

[56] References Cited

UNITED STATES PATENTS

| | | | |
|---|---|---|---|
| 1,189,137 | 6/1916 | Klingelhofer | 312/268 |
| 2,829,024 | 1/1958 | Crawford | 312/268 |
| 2,873,160 | 2/1959 | Broad, Jr. | 312/268 |
| 2,875,014 | 2/1959 | Moore | 312/268 |

*Primary Examiner*—Casmir A. Nunberg
*Attorney, Agent, or Firm*—Herbert L. Lerner

[57] ABSTRACT

Traveling holder for textile coils includes a receptacle, and an elevator disposed in the interior of the receptacle, the elevator having a loopshaped travel path within the receptacle.

4 Claims, 9 Drawing Figures

TRAVELING HOLDER FOR TEXTILE COILS

This is a continuation of application Ser. No. 441,337, filed Feb. 11, 1974, now abandoned.

The invention relates to a traveling or mobile holder or receptacle for textile coils.

Textile coils, especially the types that have become known as cheeses or cross wound bobbins, represent an important intermediate product because, with the completion of such coils, the yarn or thread manufacture is ended in most instances and the production of areal or two-dimensional entities can begin. For this purpose, large quantities of coils must be safely stored and transported within a manufacturing plant: To be able to effect trouble-free further processing thereof, the coil or bobbin structure and surface must not be damaged or soiled.

Heretofore known receptacles for transporting and storing textile coils are predominantly open, frequently also mobile boxes, that are formed solely of a base and side walls. Furthermore, traveling racks or frames have been known theretofore wherein the coils are stuck onto arbors. With such racks, it is difficult or only possible at very great expense to store or empty the coils automatically. Also, coil carriages have been known heretofore wherein cheeses have been mounted one above the other in tiers. The individual tiers of coils can be connected by channels, thereby facilitating the loading and unloading thereof. Such coil carriages have the disadvantage, however, that when the cheeses are being loaded and unloaded, they must be rolled or slid, causing damage to the thread or yarn layers at the surface of the cheeses.

It is accordingly an object of the invention to provide a traveling holder or receptacle for textile coils which avoids the foregoing disadvantage of the heretofore known devices of this general type, and which affords automatic loading and unloading thereof without complex equipment. A further object of the invention is to provide such a holder or receptacle which ensures safe handling and storage of the coils and which is adequately mobile so as to be transportable from one processing stage to others.

With the foregoing and other objects in view, there is provided, in accordance with the invention, a traveling holder for textile coils comprising a receptacle, and an elevator disposed in the interior of the receptacle, the elevator having a loopshaped travel path within the receptacle.

In accordance with another feature of the invention, the elevator comprises a pair of endless conveyor chains, and a multiplicity of troughs articulatingly suspended between the conveyor chains. By so equipping the interior of the receptacle, the receptacle can be covered on all sides thereof except for a sole loading and unloading opening matching or corresponding to the size of the coil, and maximal utilization of the inner space of the receptacle can be achieved by the substantially sinusoidally wave-shaped and loopshaped path of the elevator.

To prevent swinging of either empty or coil-containing, troughs during circulating travel thereof within the receptacle, in accordance with a further feature of the invention an endless stabilizing chain is coordinated with and located adjacent each of the endless conveyor chains, respectively.

To prevent lateral shifting of the stabilizing chains or to limit upward or downward movement thereof, in accordance with an added feature of the invention, guide rail means are respectively coordinated with and located adjacent the endless stabilizing chains.

in accordance with yet another feature of the invention, each of the stabilizing chains is formed of a multiplicity of links substantially double in number to the mulitplicity of troughs. Such a construction results in an especially simplified stabilizing chain having adequate stablizing effect.

In accordance with an additional feature of the invention, the links of the stabilizing chains have joints spaced one from the other substantially half the distance that the troughs are spaced one from the other.

In order that the troughs should always maintain their horizontal position even in the arcuate sections of the reversal locations of the loop-shaped path of the conveyor chains and also in order to exclude any swinging thereof in these regions, there have further been provided, in accordance with the invention, disc members eccentrically suspended from opposite joints of the stabilization chain links, and a support bracket, respectively, mounted at respective end faces of the troughs and secured on the respective disc members.

In accordance with a concomitant feature of the invention, which affords an especially safe support for all coils suitable for storage or transport in the receptacle of the invention, the troughs are formed as basket-shaped support gratings. In this way, dust deposition in the troughs can be avoided. It is furthermore possible, with such a construction, to drive the filled receptacle into a steam-applying, dampening or drying installation, since the basket-shaped support gratings of the troughs assure a uniform penetration by gaseous or liquid media of the coils stored therein.

It is furthermore advantageous for automatic loading and unloading of the receptacle or holder of the invention, when the troughs in spite of being suspended from the stabilizing chains are nevertheless able to tilt to a necessary extent without placing the troughs in an unstable position during travel of the receptacle or holder or when advancing the troughs along their loop-shaped path.

Therefore, in accordance with another feature of the invention, the support gratings comprise rods extending parallel to the longitudinal axis of the troughs, one of the outer two rods thereof being pivotally mounted in the support brackets and the other of the outer two rods being seated on a support.

Although the invention is illustrated and described herein as Traveling Holder for Textile Coils, it is nevertheless not intended to be limited to the details shown since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings in which.

Figure 1:
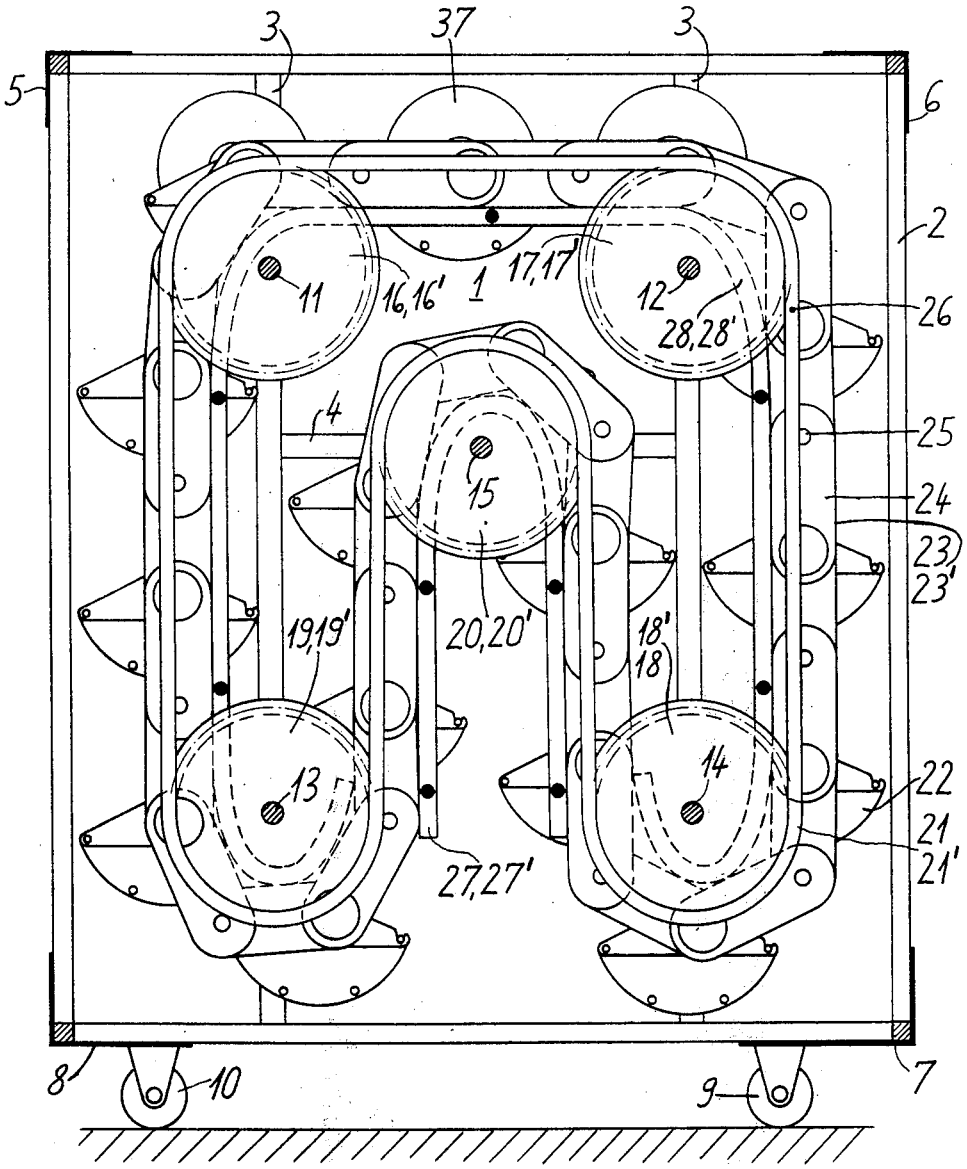
FIG. 1 is a longitudinal and vertical sectional view of the holder or receptacle for textile coils constructed in accordance with the invention.

Referring now to the drawing and first, particularly, to FIG. 1 thereof, there is shown in vertical sectional view the holder or receptacle 1 for textile coils of the invention, which has a frame 2 that is reinforced by two longitudinal vertical beams 3 and a horizontal cross-beam 4. The covering on all sides of the receptacle 1 is retained by the angle irons 5, 6, 7 and 8. Two pairs of rollers 9, 10 (only one of each of which is seen in FIG. 1) are fastened to the lower angle irons 7 and 8, the rollers being either fixed, pivotable or a combination of both fixed and pivotable. Shafts 11, 12, 13 and 14 are rotatably mounted in the longitudinal beams 3, and shaft 16 is similarly rotatably mounted in the cross beam 4. Pairs of sprocket wheels 16, 16', 17, 17', 18, 18', 19, 19' and 20, 20' are respectively mounted on the shafts 11 to 15. The sprocket wheels 16 to 20 are located exactly opposite the sprocket wheels 16' to 20' on the other side of the receptacle 1. Conveyor chains 21 and 21' travel around all of the aforementioned sprocket wheels 16 to 20 and 16' to 20' that are located adjacent the side walls of the receptacle 1. A multiplicity of troughs 22 are connected with the conveyor chain 21 and 21', and will be described hereinafter with greater particularity respecting constructional details and the mounting thereof. It is readily seen from FIG. 1 that the disposition of the sprocket wheels 16 to 20 and 16' to 20' and the conveyor chains 21 and 21' and the troughs 22 traveling around the sprocket wheels form an elevator, the shape or path of which makes possible especially favorable utilization of the space within the receptacle 1. The substantially sinusoidally wave-shaped and loop-shaped path of the elevator shown in FIG. 1 moreover, results in a virtually square cross section for the surrounding receptacle 1 and thereby permits a wide spacing between the roller pairs 9 and 10 which is advantageous for reliable travel of the receptacle. In spite of the mutual spacing of the troughs 22 required because of the reversing arcs or bends at the ends of the respective pair of runs in the conveyor chains 21 and 21', the base of the receptacle 1 for storing, for example 50 cross-wound coils or cheeses is only negligibly larger than that of a simple conventional coil carriage wherein the cheses are stacked one on top of the other without any spaces therebetween. In all simple conventional coil carriages known heretofore, a height such as that of the receptacle 1 could never by used because a person filling or emptying the receptacle could then only reach down to a depth of the receptacle of one meter, at most.

Figure 2:
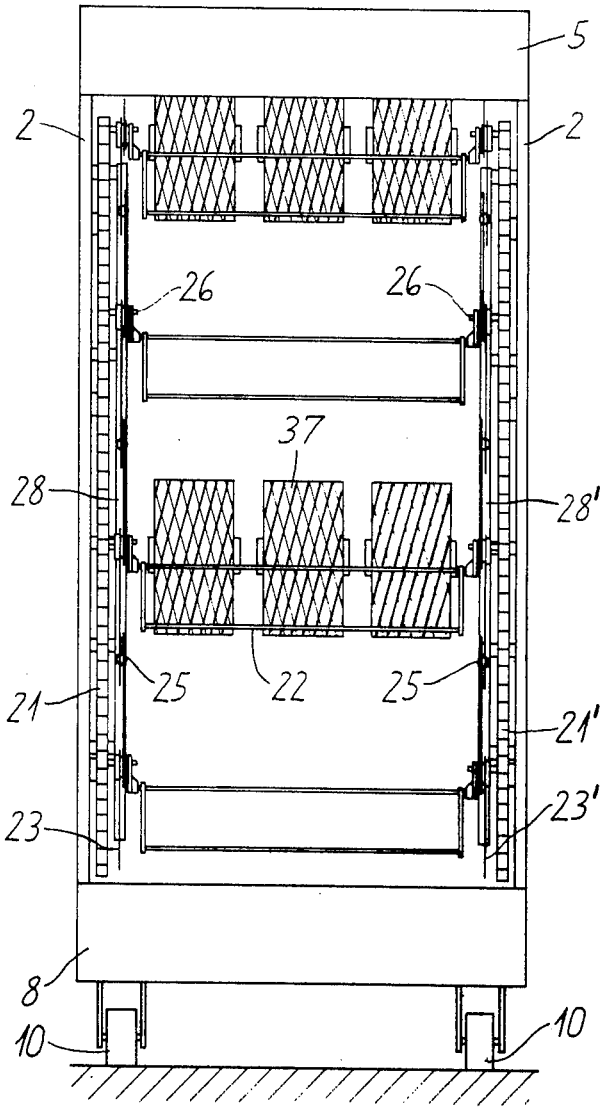
FIG. 2 is a front elevational view of the holder or receptacle.

It is apparent in FIG. 1 and also especially clearly in FIG. 2 how stabilizing chains 23, 23' formed of links 24 travel around with and parallel to each conveyor chain 21, 21'. The links 24 of the stabilizing chains 23, 23' are connected by joint pins 25 and 26 one to another. One of the troughs 22, respectively, is fastened to the opposing pins 26 of the stabilizing chains 23, 23'. The particular form of fastening is described hereinafter with respect to FIGS. 3 and 4. Each stabilizing chain 23, 23' is laterally braced against guide rails 27, 27' and 28, 28', respectively, as shown in FIG. 1.

Figure 3:
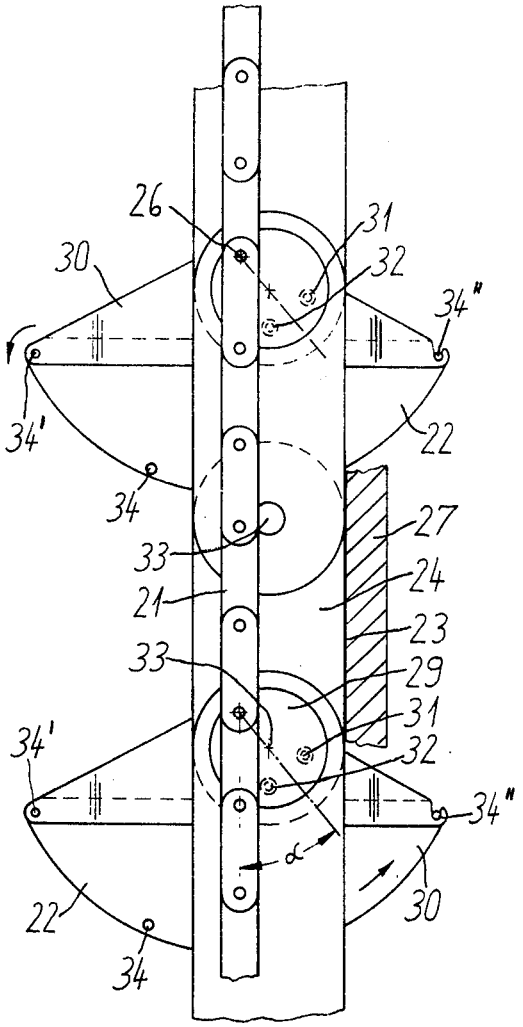
FIG. 3 is an enlarged fragmentary view of FIG. 1 showing the mounting of the troughs at the conveyor and stabilizing chains.
Figure 4:
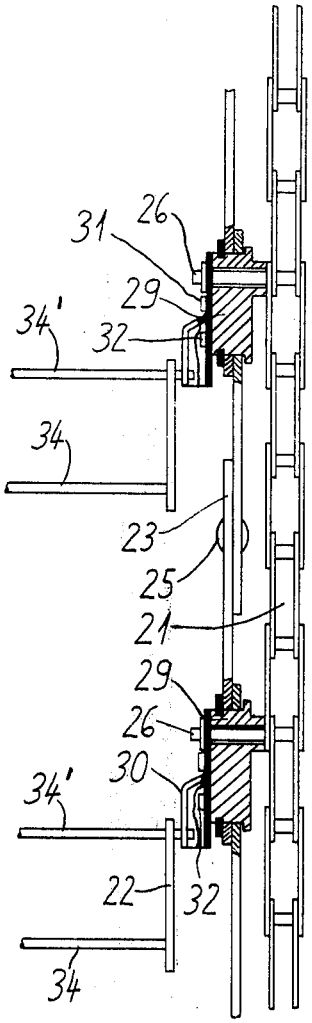
FIG. 4 is an elevational view of the left-hand side of FIG. 3.

In FIGS. 3 and 4, there is clearly illustrated the manner in which discs 29 are eccentrically suspended on the joint pins 26 of the stabilizating chains 23 and 23', respectively that are simultaneously connected to the respective conveyor chain 21 or 21'. Support brackets 30 for the troughs 22 are also suspended from the joint pins 26 are additionally tightly screwed to the discs 29 by screws 31 and 32. It is advantageous if the anlge $\alpha$, which is defined by a vertical line through the hinge pin 26 and a connecting line from the center of the joint pin 26 through the center of the disc 29, which is simultaneously the joint or articulation point 33 of the stabilizing chain 23, 23', is about 45°. If the support bracket 30 is moved counterclockwise about joint pin 26, the stabilizing chain 23 or 23' tends to move upwardly and to the right hand side as viewed in FIG. 3. Because of the guide rails 27, 27' and 28, 28', fragmentarily shown in section, the shifting of the stabilizing chains 23 and 23', respectively, toward the right hand side of FIG. 3 is restricted. The conveyor chain 21 or 21' could then also move toward the left hand side of FIG. 3 but this is prevented by the tension of the chain as can be seen in FIG. 1, movement of the stabilizing chain 23, 23' upwardly is also limited because it lies on the arcuately extending guide rails 27, 27' and 28, 28' at the reversing locations which, in turn, prevents lifting of the vertical stabilizing chain link 24. If the discs 29 are disposed in exactly mirror-image manner on the side opposite the plane of the drawing, this side and especially the clockwise movements of the support bracket would then be blocked. Marked stabilization of the support bracket 30 and the troughs 22 toward both directions is thereby assured. At the reversing locations formed by the sprocket wheels 16, 16' to 20, 20', the position of the troughs 22 with respect to the conveyor and stabilizing chains must vary. This occurs under the action of its own weight and the curving path of the guide rails 27, 27' and 28, 28' respectively. Due to the stabilizing chains 23, 23', the troughs 22 can pivot only negligibly out of the horizontal disposition thereof, and no especially high accuracy is required for the guide rails 27, 27' and 28, 28', respectively.

It is furthermore apparent from FIG. 3 that the troughs 22 are formed as basket-like support gratings and have rods 34 extending parallel to the longitudinal axis of the troughs 22. The outer rod 34' is rotatably mounted in the support bracket 30. On the opposite side, the trough 22 is supported by the rod 34'' in a recess formed in the support bracket 30. In this manner, each trough 22 is able to be tilted or tipped counterclockwise about the rod 34'.

In FIG. 4 there is especially clearly shown one of the quite outwardly lying conveyor chains 21 and the stabilizing chain 23 adjacent thereto. The support brackets 30 are bent inwardly in vicinity of the rods 34' and 34'' so that the troughs 22 do not come into contact with the stabilizing chains 23 and 23', respectively.

Figure 5:
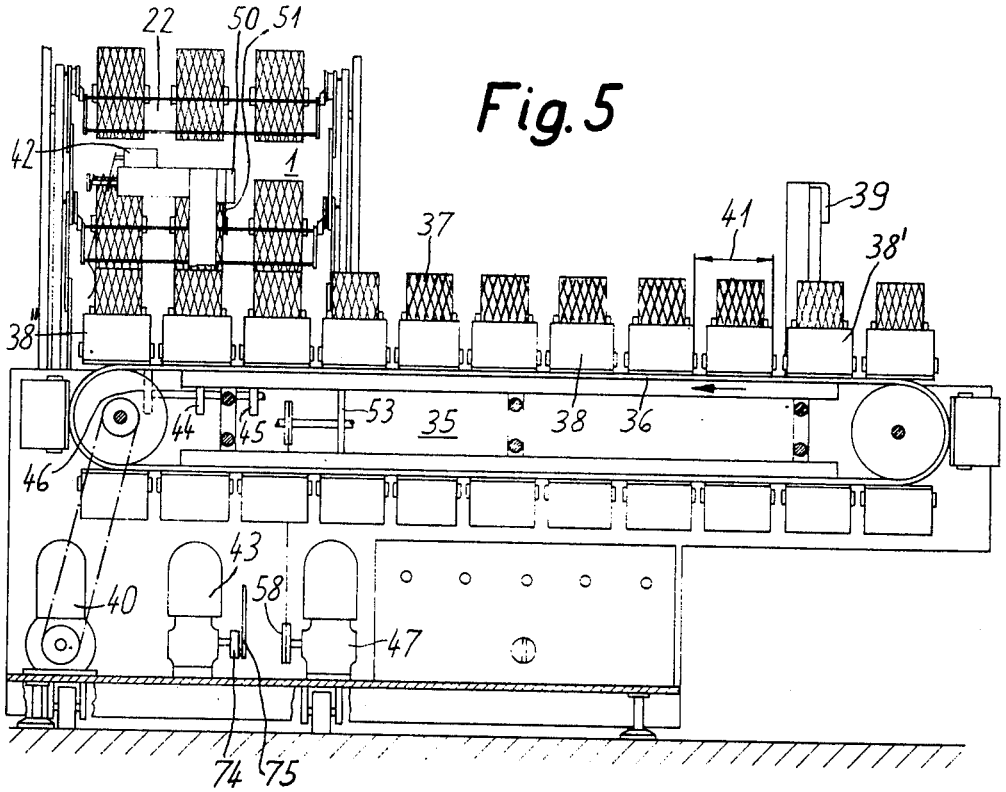
FIG. 5 is an elevational view of the holder or receptacle in assembly with a coil loading device.

FIGS. 5 to 9 illustrate various suitable means for automatically loading and unloading the receptacle 1 of the invention. In FIG. 5 there is shown a loading device 35 in front of the receptacle 1. The operation thereof is as follows: Coils or cheeses 37 are transported by trough-like entrainers 38 on a conveyor belt 36 to the receptacle 1. The conveyor belt 36 is located at the entrainer 38'. The coils 37 can be placed there manually, however more likely, the coils would be delivered thereat by a cross-winding machine. The coils 37 can be supplied continually or at irregular intervals. Everytime a coil 37 reaches the location of the entrainer 38' on the conveyor belt 36, a switch 39 is actuated, and the conveyor belt 36 is advanced one entrainer division or spacing 41 by a geared motor 40. If the conveyor belt 36 is so filled that a coil 37 has advanced to the location of the entrainer 38'', a switch 42 is actuated. A tilting motor 43 is then energized and actuates tilting levers 44, 45 and 46 so that three entrainers 38 located in front of the receptacle 1 are tilted, and the coils 37 can then fall into a trough 22 within the receptacle 1. For this purpose, the tilting motor 43 starts to turn a crank 74 with a connecting rod 75 through one rotation. The connecting rod 75 is connected to a lever 76 (FIG. 6) which, through a rod 77, pivots another lever 78 and by means thereof and a rod 79 pivots tilting lever 45. When the tilting has ended, the motor 47 starts up and moves the elevator in the receptacle 1 one trough spacing farther.

Figure 6:
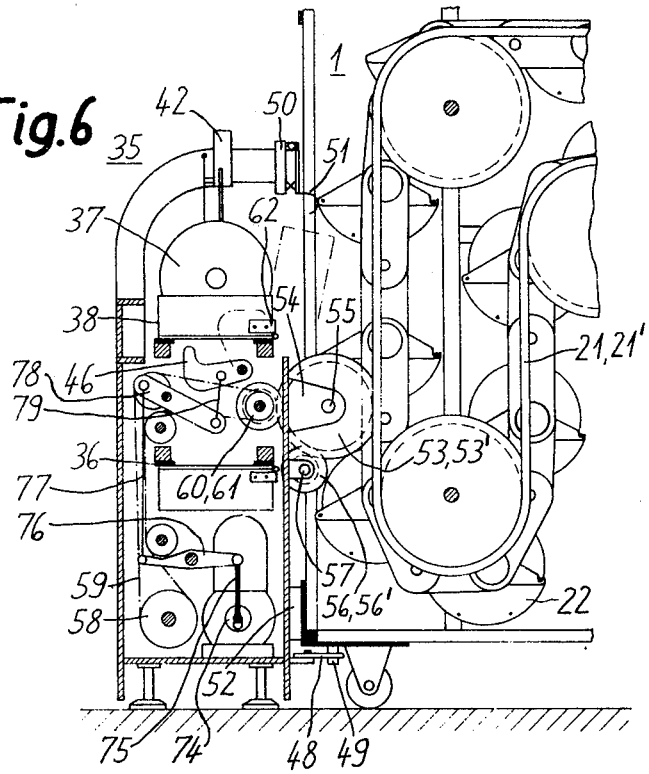
FIG. 6 is a vertical cross-sectional view of FIG. 5 showing the loading device and the holder or receptacle according to the invention.

In the cross-sectional view of the loading device 35 of FIG. 6, one can see how the receptacle 1 is coupled thereto. The loading device 35 has pawls 48 which engage in pins 49 that are secured to the receptacle 1 when the receptacle 1 has assumed the proper position. The correct positioning of the troughs 22 with respect to the loading device 35 is effected by a switch 50. The switch 50 has a tab 51 that is engaged by a trough 22 thereby actuating the switch 50. When the switch 50 is actuated, the downwardly suspended trough 22 is then located at the correct level. In order that the correct level of the troughs 22 be always attained at the institution of an empty receptacle 1, when the latter is coupled to the loading device, a non-illustrated switch can be actuated by a contact member 52 to switch on the drive of the elevator within the receptacle 1 long enough so that a trough 22 contacts the tab 51 of the switch 50. The drive for the elevator is provided by sprocket wheels 53 and 53' respectively engaging in one or both conveyer chains 21 and 21', respectively. In order that the troughs 22 be able to pass by the bearing of the spocket wheels, they are mounted in overhung position on an arm 54. The axial pin 55 does not connect the sprocket wheels 53 and 53' one to the other, but rather, the rotational connection is produced through the gears 56, 56' and the shaft 57 extending therethrough. The shaft 57 is located outside the range of travel of the troughs 22. The sprocket wheels 53, 53' are driven by the motor 47 (FIG. 5) with a sprocket wheel 58 flanged thereto and through chains 59 which transfer the driving force of the motor 47 to the sprocket wheel 60. Agear 61, which is operatively connected to one of the sprocket wheels 53, is also connected to the sprocket wheel 60. It can also be seen in FIG. 6 that the entrainers 38 are supported or braced on one side of the conveyor belt 36 whereas they are tiltably mounted at the other side in a hinge 62. By a non-illustrated torsion spring in the hinge 62, the empty entrainers in the lower run of the conveyor belt 36 are prevented from hanging down. The tilting lever 46 is moreover shown in the phantom position it assumes when tilted and swings one of the entrainers 38 into the corresponding position thereof shown in phantom.

Figure 7:
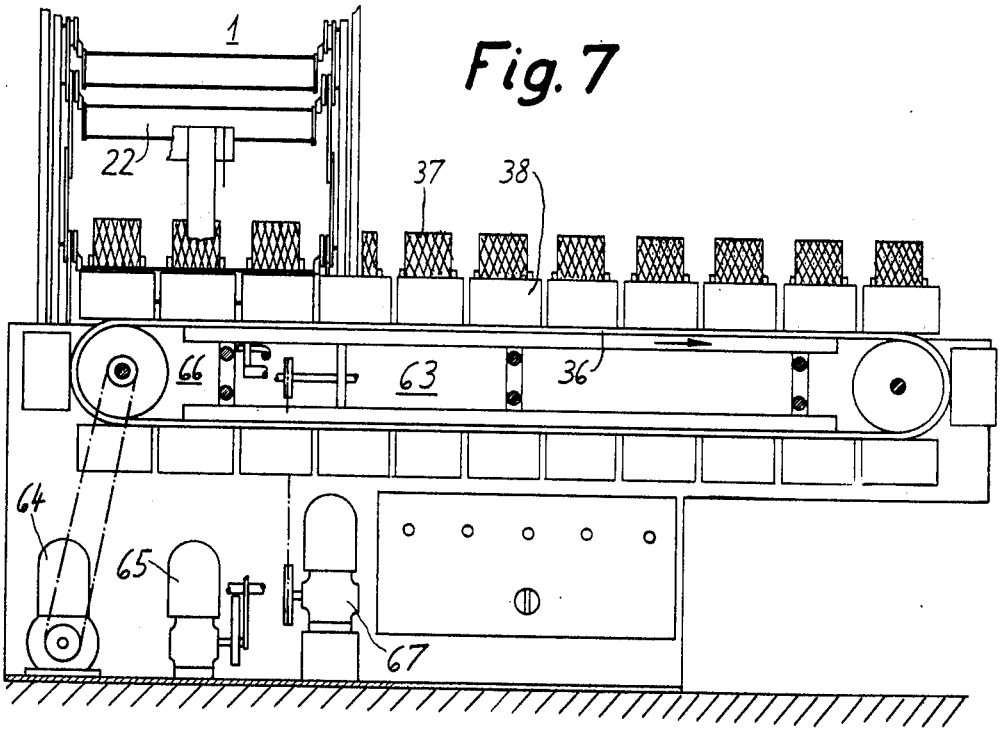
FIG. 7 is a view similar to FIG. 5 of the holder or receptacle of the invention in assembly with a coil unloading device.

In FIG. 7, there is shown an unloading device 63 located in front of the receptacle 1. The conveyor belt 36 of this device takes up the coils 37 from the receptacle 1, depositing them in the entrainers 38. The coils 37 can be transported by the conveyer belt 36 to a further processing location, for example to a packaging machine or to a coil mounting device for magazine creels and the like. The conveyor belt 36 is driven stepwise by the geared motor 64. The geared motor 65 drives the tilting device 66 for emptying the troughs 22, and the geared motor 67 stepwise advances the troughs 22 of the elevator disposed in receptacle 1.

Figure 8:
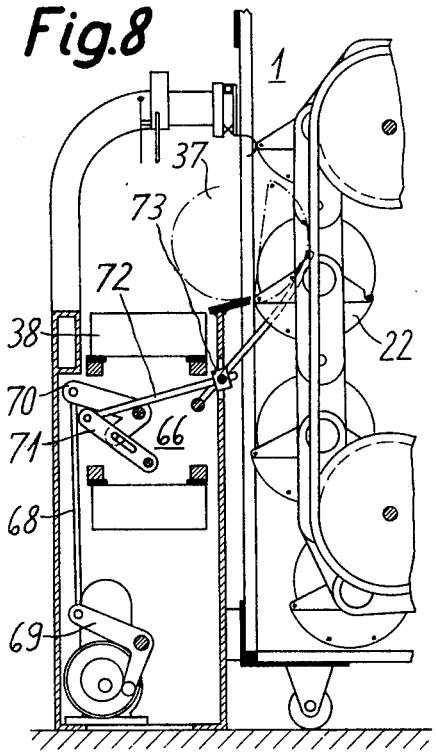
FIG. 8 is a vertical cross-sectional view of FIG. 7 showing the unloading device and the holder or receptacle of the invention, and including a device for tilting the troughs.

In FIG. 8, the tilting device 66 for the troughs 22 is shown in detail. When a tie rod 68 is drawn downwardly by a cam lever 69, a bell crank 70 pivots counterclockwise and turns a lever 71 in the same rotary direction. An engaging rod 72 thereby slides in a guide member 73 under a trough 22 of the receptacle 1 and tilts into the position shown in phantom in FIG. 8 so that the coils 37 of one trough 22 can fall into the corresponding number of entrainers 38 of the conveyor belt 36.

Figure 9:
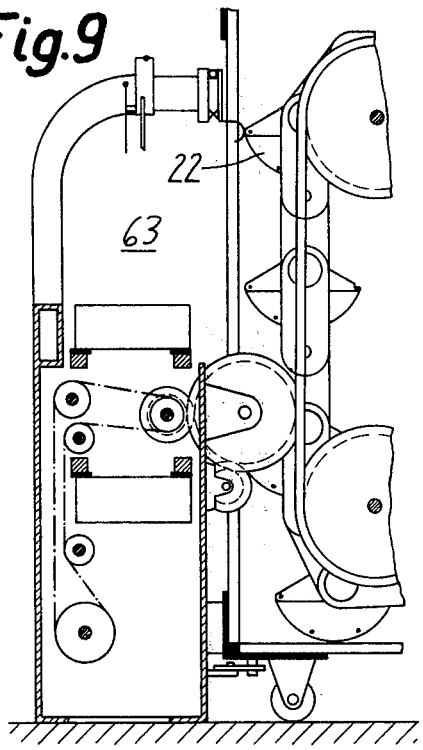
FIG. 9 is a view similar to FIG. 8 including a device for advancing the troughs along their loop-shaped travel path.

The drive for advancing the troughs 22 shown in FIG. 9 operates in a manner similar to the drive shown in FIG. 6 and described hereinbefore.

The aforedescribed unloading device 63, as a stationary assembly in connection with the receptacle 1 of the invention, can form a part of loading systems of rewinding machines, double twist twisting machines, bobbin creels, dyeing machines, packaging machines or coil tube exchanging machines. As a traveling assembly the unloading device 63 is installable as part of loading systems, looms, knitting machines, unwinding machines or double twist twisting machines.

It is claimed:

1. Traveling holder for textile coils comprising a receptacle, and an elevator disposed in the interior of said rereptacle, said elevator comprising endless conveyor means having at least two adjacent runs extending in a wave-shaped loop along a substantially sinusoidal travel path within said receptacle for maximum utilization of space within said receptacle, said endless conveyor means comprising a pair of endless conveyor chains, each having said two adjacent runs, and a multiplicity of troughs articulatingly suspended between said conveyor chains, said elevator further including endless stabilizing chains respectively connected to said conveyor chains and extending adjacent and in substantially parallel relationship thereto along the entire length thereof, and guide rails adjacent to said stabilizing chains, said stabilizing chains being in gliding engagement with said guide rails along said travel path so as to travel together with said conveyor chains simultaneously along said travel path.

2. Traveling holder for textile coils comprising a receptacle and an elevator disposed in the interior of said receptacle, said elevator comprising endless conveyor means having at least two adjacent runs extending in a wave-shaped loop along a substantially sinusoidal travel path within said receptacle for maximum utilization of space within said receptacle, said endless conveyor means comprising a pair of endless conveyor chains, each having said two adjacent runs, and a multiplicity of troughs articulatingly suspended between said conveyor chains, said elevator further including endless stabilizing chains respectively connected to said conveyor chains, and guide rails adjacent to said stabilizing chains, said stabilizing chains being in gliding engagement with said guide rails along said travel path, said troughs including support brackets on respective end faces thereof, said stabilizing chains comprising a plurality of chain members having mutually connecting joints, a plurality of discs connected at said joints of said stabilizing chain members, said discs being connected to said support brackets, respectively, a plurality of joint pins, eccentrically disposed on said discs, respectively, and connected to one of said conveyor chains, the discs being eccentrically suspended by means of said joint pins on the respective conveyor chains.

3. Traveling holder according to claim 2 wherein said troughs are formed as basket-shaped support gratings.

4. Traveling holder according to claim 3, said support gratings comprising rods extending parallel to the longitudinal axis of said troughs, one of the outer two rods being pivotally mounted in said support brackets and the other of said outer two rods being seated on a support.

* * * * *